US005385034A

United States Patent [19]

Haselden

[11] Patent Number: 5,385,034

[45] Date of Patent: Jan. 31, 1995

[54] VAPOR COMPRESSION SYSTEMS

[75] Inventor: Geoffrey G. Haselden, Leeds, England

[73] Assignee: The University of Leeds, Leeds, England

[21] Appl. No.: 50,303

[22] Filed: Apr. 2, 1993

[30] Foreign Application Priority Data

Apr. 10, 1990 [GB] United Kingdom ..... 9021611

[51] Int. Cl.[6] ..... F25B 41/04

[52] U.S. Cl. ..... 62/218; 62/526; 62/527; 137/197

[58] Field of Search ..... 62/218, 471, 526, 527; 137/196, 450, 625.34

[56] References Cited

U.S. PATENT DOCUMENTS

| | | | |
|---|---|---|---|
| 2,133,962 | 10/1938 | Shoemaker | 62/218 X |
| 2,267,152 | 12/1941 | Gygax | 62/218 |
| 2,364,783 | 12/1944 | Goddard et al. | 62/115 |
| 2,540,361 | 2/1951 | Whitley | 137/450 X |
| 3,232,313 | 2/1966 | Bering | 137/450 |

*Primary Examiner*—William E. Wayner

*Attorney, Agent, or Firm*—Darby & Darby

[57] ABSTRACT

A vapour compression system, in which the pressure and flow rate of refrigerant in components of the system to control and to optimize use of heat-transfer surfaces and to minimize power consumption, comprises a compressor 1, a condenser 5, a two-section evaporator 15, and a needle float valve 13 for maintaining a pressure differential between the condenser and the evaporator. The two section evaporator comprises a first section 17 which receives refrigerant from the condenser and which partially evaporates it to discharge two-phase refrigerant into a reservoir 23 in which liquid refrigerant is collected and from which low pressure refrigerant vapour is supplied to the compressor, and a second section 19 which receives liquid refrigerant from the reservoir and evaporates it at least partially. The needle float valve may include a tapered needle, having two tapered portions which fit-into respective orifices, flow of fluid through the orifices being in opposite directions, so that the force required to open the valve or to maintain it in a partly open position is independent of the pressure drop across it.

17 Claims, 3 Drawing Sheets

VAPOR COMPRESSION SYSTEMS

The present invention relates to vapour compression systems as used in, for example, refrigerators, air conditioners and heat pumps, and to components thereof such as evaporators, condensers and float valves.

Known vapour compression systems comprise an evaporator, a condenser and a compressor for raising the pressure of refrigerant vapour from that which prevails in the evaporator (where the refrigerant takes in heat) to that which prevails in the condenser (where the refrigerant loses heat). Condensed liquid refrigerant is supplied from the condenser to the evaporator through an expansion device which maintains the pressure difference between the condenser and the evaporator and regulates the flow of refrigerant through the system. In many applications, the components of such systems are assembled together into integrated sealed units.

Particularly when a vapour compression system is required to cool a fluid through a temperature range while rejecting heat to another fluid which warms up through a temperature range, the efficiency of the system can be increased by using a refrigerant which consists of two or more mutually soluble substances, which do not form an azeotrope*. The boiling points of the two substances are separated by about 10° to 50° C. By appropriate selection of substances for the mixed refrigerant, the boiling point of the mixed refrigerant as it condenses can be arranged to follow closely the temperature of the fluid being heated in the condenser throughout the length of the condenser with the refrigerant and heat transfer fluid flowing in countercurrent relationship with each other. Similar considerations apply to the evaporator. As a result, less power is required in order to drive the compressor because the rise in pressure required of the compressor is less.

However, a significant design constraint with a mixed refrigerant, as it progressively condenses or evaporates, is that the resulting two phases of the mixture should flow co-currently at all times and be in intimate heat and mass transfer relationship with each other. Further information concerning the use of mixed refrigerants in vapour compression systems can be found in the Proceedings of the Institute of Refrigeration (1974-5) vol. 71, pages 18 to 23.

A number of operating requirements can be defined even for a pure refrigerant vapour compression system to operate at optimum efficiency. While it is widely known how to design such a system to operate efficiently under a single set of conditions, it is very much more difficult to design a system which will operate efficiently under a range of differing duties, due for instance to widely varying ambient conditions, or when the system is turned down, for example by reducing the displacement of the compressor so that its cooling effect is reduced. It is particularly difficult to ensure that a system also operates efficiently in the transitional state between one duty and another, for example during start-up. The use of mixed refrigerants introduces yet another complication.

It is generally required for optimum operating efficiency of a vapour compression system that all of the heat transfer surfaces of the condenser and of the evaporator are available for effective duty under all operating conditions. In the case of the condenser, this requires that there should not be a build-up of condensed liquid refrigerant at the outlet from the condenser which will mask part of the heat transfer surface. In the case of the evaporator, this requires that liquid refrigerant shall wet the heat transfer surface throughout the length of the evaporator. These requirements should preferably be met simultaneously whilst the overall inventory of refrigerant within the system remains constant. However, a further requirement is that liquid refrigerant should not enter the compressor, where it might cause damage. In order to avoid this problem, it is common for refrigerant vapour leaving the evaporator to be super-heated by about 5° C. However, this solution has the significant disadvantage that, because the heat transfer coefficient for super-heating the vapour is very much lower than that for evaporation, the amount of evaporator surface required for super-heating is far greater than the actual heat load would indicate. Typically, therefore, the amount of heat transfer surface is increased by at least 25% in order to super-heat the vapour.

A further factor which affects the behaviour of vapour compression systems is the presence of oil in the compressor, which can become entrained in refrigerant vapour leaving the compressor. The oil is carried with the vapour into the condenser and then with the condensate into the evaporator, where it can be deposited and interfere with heat-transfer. To minimise this problem, designers of vapour compression systems seek to reduce entrainment and to ensure that the entrained compressor oil is swept through the condenser and evaporator as quickly as possible, and returned to the compressor.

The present invention provides a modified vapour compression system for use with pure and mixed refrigerant systems, in which the pressure and flow rate of refrigerant in components of the system are controlled to optimise use of heat-transfer surfaces and to minimise power consumption.

In one aspect, the invention provides a vapour compression system in which a quantity of a refrigerant circulates between at least two pressure levels, comprising:

(a) a compressor for increasing the pressure of refrigerant vapour;

(b) a condenser for high pressure refrigerant vapour received from the compressor;

(c) an evaporator for liquid refrigerant received from the condenser, from which low pressure refrigerant vapour is supplied to the compressor;

(d) means for minimising the supply of liquid refrigerant to the compressor; and (e) an expansion valve which controls the supply of liquid refrigerant from the condenser to the evaporator the valve being arranged to open when the quantity of condensed liquid refrigerant within or behind it reaches a pre-determined level, the force required to open the valve being substantially independent of the pressure drop across it.

The means for minimising the supply of liquid refrigerant to the compressor preferably takes the form of a reservoir into which liquid refrigerant discharged from the evaporator collects. However, the supply of liquid refrigerant may be minimised, or even prevented, by superheating the refrigerant vapour as it leaves the evaporator.

In another aspect, the invention provides a vapour compression system in which a quantity of a refrigerant circulates between at least two pressure levels, comprising:

(a) a compressor for increasing the pressure of refrigerant vapour;
(b) a condenser for high pressure refrigerant vapour received from the compressor;
(c) an expansion device for maintaining a pressure differential between the condenser and the evaporator, through which liquid refrigerant is discharged from the condenser to the evaporator; and
(d) a two-section evaporator for liquid refrigerant, which comprises:
(i) a first evaporator section which receives refrigerant from the condenser through the expansion device and which partially evaporates it, discharging two-phase refrigerant into a reservoir in which liquid refrigerant is collected, and from which low pressure refrigerant vapour is supplied to the compressor, and
(ii) a second evaporator section which receives liquid refrigerant from the reservoir and evaporates it at least partially.

In a further aspect, the invention provides a vapour compression .system in which a quantity of a refrigerant circulates between at least two pressure levels, comprising:
(a) a compressor for increasing the pressure of refrigerant vapour;
(b) a condenser for high pressure refrigerant vapour received from the compressor;
(c) an expansion valve through which liquid refrigerant is discharged from the condenser the valve being arranged to open when the quantity of condensed liquid refrigerant within or behind it reaches a pre-determined level, the force required to open the valve being substantially independent of the pressure drop across it; and
(d) a two-section evaporator for liquid refrigerant, which comprises:
(i) a first evaporator section which receives refrigerant from the condenser through the expansion valve and which partially evaporates it, discharging two-phase refrigerant into a reservoir in which liquid refrigerant is collected, and from which low pressure refrigerant vapour is supplied to the compressor, and
(ii) a second evaporator section which receives liquid refrigerant from the reservoir and evaporates it at least partially.

In another aspect, the invention provides a two-sect ion evaporator for refrigerant in a vapour compression system, which comprises:
(a) a first evaporator section for receiving condensed refrigerant under pressure from a condenser and in which it is evaporated at least partially;
(b) a reservoir for collecting liquid refrigerant discharged from the first evaporator section, and from which low pressure refrigerant vapour is supplied to a compressor; and
(c) a second evaporator section for receiving liquid refrigerant from the reservoir and in which it is evaporated at least partially.

Generally, the first evaporator section will receive condensed refrigerant from an expansion device such as a needle valve which opens when the quantity of liquid refrigerant within or behind it reaches a predetermined level.

In a further aspect, the invention provides a valve for controlling flow of fluid, the valve comprising:
(a) a shaft having two seal portions of approximately the same dimensions spaced apart from one another;
(b) a pair of equally sized orifices into which the seal portions can be received, arranged so that movement of the shaft opens both orifices approximately simultaneously;
(c) an inlet through which fluid enters the valve, and an outlet through which fluid leaves the valve, the inlet and outlet being so connected that fluid flows through the orifices in opposite directions; and
(d) a float which is attached to the shaft and located in a chamber so that movement of the shaft is dependent on the amount of a liquid in the chamber.

Preferably, the seal portions on the shaft of the valve will be tapered, so that movement of the shaft progressively opens both orifices approximately simultaneously.

The use of a two-section evaporator with an associated reservoir in a vapour compression system has the significant advantage that it can ensure that optimum use is made of the entire heat-transfer surface within the evaporator. The use of a reservoir into which refrigerant at low pressure from the first evaporator section is discharged makes it possible for the refrigerant within the first evaporator section to exist throughout the length of that section in both liquid and vapour phases, while ensuring also that liquid refrigerant is not then supplied to the compressor. Instead, the compressor draws only refrigerant vapour from the reservoir. Furthermore, the reservoir provides the location in which refrigerant, not required under particular conditions of loading in the condenser, the evaporator and the compressor, can be stored. This is particularly significant in systems which include a valve through which refrigerant is discharged from the condenser which opens when the quantity of liquid refrigerant behind or within it reaches a predetermined level, and ensures that such excess refrigerant does not back up behind the valve and so mask the heat transfer surfaces of the condenser. It is also significant in systems which have to handle wide variations in duty due, for example, to changes in ambient temperature, or running under part load.

The first evaporator section will generally be significantly longer than the second evaporator section. For example, the first evaporator section may be at least about three times, preferably at least about four times, more preferably at least about five times the length of the second evaporator section. Refrigerant passes through the first evaporator section under the pressure prevailing at discharge from the expansion device, and its flow resistance can be optimised to give a high rate of heat transfer without causing an excessive rise in boiling point. By contrast, refrigerant will generally pass through the second evaporator section as a result of natural circulation evaporation, and its flow resistance will generally be designed to be relatively low.

The first evaporator section, and in many cases also the second evaporator section, may be constructed as a plurality of finned tubes which are interconnected near the inlet to and outlet from the evaporator, and between which the flow of refrigerant is divided.

The first section of the evaporator may include junctions or headers between tubes in which refrigerant flows in parallel. For example, the number of tubes may be doubled part way through the first section in order to optimise the two-phase velocity of refrigerant taking into account the change in specific volume of the refrigerant as it evaporates. A similar approach may be used in the condenser to optimise two-phase flow as the specific volume of refrigerant diminishes as it condenses. Headers may be used to reduce the number of condenser tubes connected in parallel.

The use of a second evaporator section into which liquid refrigerant is supplied, preferably by gravity circulation, from the reservoir has the effect of ensuring that, at all times under steady state operating conditions, refrigerant discharged from the first evaporator section into the reservoir contains a proportion of liquid phase. The relative proportions of refrigerant in liquid and vapour phases discharged from the first evaporator section are determined by the rate of evaporation in the second evaporator section. This is because the net quantity of liquid refrigerant from the reservoir which evaporates in the second evaporator section must be replaced, according to the requirements of an overall mass balance, by liquid refrigerant from the first evaporator section: in a closed system, liquid cannot be continuously withdrawn from a vessel such as the reservoir unless it is replaced at the same rate, if the amount present in the remaining parts of the system is constant. The rate of evaporation in the second section of the evaporator is determined by, amongst other things, the length of the second evaporator section, which will be chosen to ensure an appropriate degree of wetness of refrigerant discharged from the first evaporator section. The pressure in the receiver will adjust itself to establish and to maintain the overall mass balance.

The refrigerant discharged from the second evaporator section will generally comprise vapour together with, in many circumstances, liquid, which may include some oil.

Refrigerant discharged from the second section of the evaporator is preferably discharged into the reservoir. However, when the amount of liquid refrigerant in the discharge is low, the discharge may be supplied directly to the compressor.

Preferably, the second evaporator section is constructed as at least one tube which is separate from the tube or tubes making up the first evaporator section. There will therefore be no mixing in the evaporator of refrigerant from the first and second sections. In another embodiment, however, refrigerant in the first evaporator section may mix with refrigerant in the second evaporator section. For example this may be achieved by injecting refrigerant from the reservoir into an evaporator tube in which refrigerant received from the condenser flows, towards the end of that tube. The flow of the refrigerant in the tube past the injector can help to withdraw refrigerant from the injector. In this arrangement, that portion of the tube downstream of the injector can be considered to be the second evaporator section, and that portion upstream of the injector the first evaporator section. Refrigerant from the first evaporator section can therefore be considered to be discharged from the evaporator through the second evaporator section.

Preferably, the expansion device by which a pressure difference between the condenser and the evaporator is maintained is a float valve. It is particularly preferred that the device be a valve which opens when the quantity of liquid refrigerant within or behind it reaches a predetermined level, and then takes up an equilibrium position in which the rate of flow through it precisely balances the rate of condensation. The use of such a valve has the advantage that accumulation of liquid refrigerant in the condenser, which would mask part of the heat-transfer surface within the condenser, is avoided. This allows the condenser pressure to be kept as low as possible, and therefore minimises the work done by the compressor. This benefit is achieved independently of the duty required of the condenser.

The ability of the valve to open when the quantity of condensed liquid refrigerant behind it reaches a predetermined level and subsequently takes up an equilibrium position in which inflow balances outflow, may be achieved in a number of ways. For example, a sensor may be provided for liquid refrigerant which, through a signal (which might be for example electrical or optical in nature), causes the valve to open when a pre-determined level of liquid refrigerant is sensed. A preferred embodiment of the system of the invention employs a float valve, in which the movable member in the valve is attached to a float provided in a chamber in which liquid can collect so that the valve opens when the quantity of liquid refrigerant within the chamber causes the float to move.

It is particularly preferred that the valve is such that the force required to open it or to maintain it in a partially open position is substantially independent of the pressure drop across it. Preferably, this is achieved by arranging the flow of fluid through the valve to be such that, when the valve is closed, the force exerted by high pressure fluid on the valve member in the direction in which the valve member moves between its open and closed positions, is virtually eliminated.

In a preferred embodiment, the valve is which a tapered needle moves into and out of an orifice into which the needle fits. Preferably, the needle has two tapered portions of the same dimensions which are provided on a single shaft, spaced apart from one another. The tapered portions fit into respective equal sized orifices arranged so that movement of the shaft opens both orifices simultaneously, the flow through and pressure drop across the orifices being in approximately opposite directions. Preferably the direction of flow of fluid through the orifices is approximately parallel to the axis of the needle, the direction of flow through one of the orifices being opposite to that through the other orifice. Preferably, the portions of the needle which are tapered are tapered over a distance of about 10 mm to about 50 mm. It has been found that the float will then find its equilibrium position to within about 0.1 mm, allowing accurate modulation of flow through the valve to be achieved.

The use of a valve in which the force required to open it or to maintain it in a partly open position is independent of the pressure drop across it has the advantage that the flow of fluid through the valve is more steady. In a valve without this feature, a relatively large force can be required initially to open the valve against the prevailing pressure drop. Once such a valve has opened, the pressure drop across it is reduced and the valve opens more widely. As a result, the initial flow of fluid through the valve tends to become a surge which is self-propagating. The use of a valve in which the force required to open it is substantially independent of the pressure drop across it removes, or at least minimises, the tendency for an initial flow of fluid through the valve to surge. This is particularly advantageous in a vapour compression system in which it is desirable to maximise efficiency, by ensuring that optimum use is made of the heat transfer surfaces in both the condenser and the evaporator. As well as removing the tendency for liquid refrigerant to collect in the condenser, the ability to provide a steady flow of refrigerant from the condenser to the evaporator makes it possible for the flow of refrigerant through the evaporator also to be controlled. In this way, particularly if the refrigeration system includes a two-part evaporator with associated reservoir, full use of the available heat transfer surface in the evaporator can be achieved.

Other types of device which could be used to maintain the pressure difference between the condenser and the evaporator include a capillary and a thermostatic device.

Refrigerant which is discharged from the second evaporator section is preferably discharged, directly or indirectly, into the reservoir. This has the advantage that liquid refrigerant can be prevented from entering the compressor. Particularly when the refrigerant is miscible with the compressor oil, the discharge of refrigerant into the reservoir may be through an oil concentrator vessel. Because of evaporation of refrigerant in the second evaporator section, the concentration of oil in the refrigerant in the oil concentrator vessel will be greater than that in the refrigerant in the reservoir. The oil concentrator vessel is connected by means of an overflow conduit to the reservoir, through which refrigerant vapour and excess liquid refrigerant can return to the reservoir. The oil concentrator vessel may be connected to the compressor by means of an oil return line, through which flow is restricted to such an extent that oil recirculation is .permitted but flow of refrigerant from the vessel to the compressor does not occur to a harmful degree.

When refrigerant and compressor oil are immiscible, so that the compressor oil floats on the surface of the liquid refrigerant, provision may be made in the reservoir to allow oil to accumulate above the refrigerant, and to be drawn away to the compressor through a port.

When the flow of refrigerant through the second evaporator section, and the rate of evaporation within it, are such that the amount of liquid refrigerant in the discharge is low, the discharge may be supplied directly to the compressor, this also making possible the return of compressor oil to the compressor.

The condenser may be cooled by air or by a liquid. Especially when the condenser is cooled by liquid (especially water), it may take the form of a vessel, into which refrigerant is discharged from the compressor. The cooling medium may pass through the chamber in one or more tubes, the outer surfaces of which provide a surface on which condensation of the refrigerant may take place. If a mixed refrigerant is used, the vessel may be fitted with baffles so that the refrigerant can flow from one end of the vessel to the other end, between the baffles, in counterflow with the liquid coolant.

More preferably and especially when the condenser is cooled by a gas such as air, it will comprise one or more condenser tubes through which the refrigerant flows, the tubes having attached to them a number of fins, over which the cooling medium flows. Condensation then takes place on the internal surface of the condenser tubes. The air-side heat transfer may be enhanced by water sprays, as in evaporative condensers.

Examples of materials which are suitable for use as refrigerants in a single refrigerant system include those designated by the marks R12, R22 and R134*a*. An additional advantage of the system of the invention is that it is particularly well suited to the use of non-azeotropic mixed refrigerants, in which it is particularly desirable that, at all places within the condenser and the evaporator, liquid and vapour refrigerant flow together co-currently and are in equilibrium, whilst the refrigerant mixture flows essentially counter-currently with the fluid with which it is exchanging heat. This objective can be achieved by the system of the invention, particularly when it includes both an expansion valve where the force required to open it is substantially independent of the pressure drop across it and a two-part evaporator with associated low-pressure reservoir. The vapour compression system of the invention therefore makes possible the power saving which is available from the use of mixed refrigerants. In addition, further power saving can be achieved because of the ability of the system of the invention to adapt to varying duty, start-up conditions, varying ambient conditions and so on, while operating at optimum efficiency. Examples of suitable mixed refrigerants include those designated by the marks R22/R142*b* and R22/R124.

It will be understood that the term "refrigerant", used in this document to denote the fluid circulating in the vapour compression system, is applicable to the fluid which circulates in systems which function as air conditioners or heat pumps.

The reservoir, into which refrigerant is discharged from the first evaporator section, will generally be arranged so that refrigerant collected within it has a large surface area. For example, the surface area of liquid refrigerant may be at least about twice the square of the height of the reservoir, preferably, at least about three times the square of that height. This has the advantage that variation in the amount of liquid refrigerant contained in the reservoir does not affect significantly the depth of the liquid and frothing of the refrigerant in the reservoir is less likely to lead to liquid refrigerant being supplied to the compressor. This allows a significant gap to be maintained between the upper surface of collected liquid refrigerant, and the outlet through which vapour is supplied to the compressor, thus minimising and preferably avoiding the possibility of liquid refrigerant being supplied in bulk to the compressor under any possible operating conditions.

The duty performed by the vapour compression system is selected by appropriate adjustment of the flow rate of the refrigerant vapour through the system. This can be achieved in a number of ways: for example, the throughput of the compressor can be adjusted, for example by adjustment of its speed or by unloading one or more cylinders, or more than one compressor may be provided of which some or all may be used according to the quantity of refrigerant required to be circulated. Alternatively, a desired amount of heat transfer may be obtained by selectively switching the compressor on and off as necessary.

The control of the compressor through-put may be in response to a detected change in temperature in the medium required to be heated or cooled by the system. For example, in a refrigeration system, a temperature sensor may be used to cause the through-put of a compressor to increase on detecting an increase in temperature of a cold chamber.

When air is used as the heat transfer medium in the condenser or the evaporator, and in cases where the duty of the unit varies widely, variable output fans may be used to modulate air flow and to conserve power.

The vapour compression system of the invention which comprises a two section evaporator and an expansion valve in which the force required to open it is substantially independent of the pressure drop across it, has the advantage of being able to adapt to varying duty, for example due to widely varying ambient conditions, or when the system is turned down, for example by reducing compressor throughput so that its cooling effect is reduced. It is able to adapt in this way while ensuring that optimum use is made of heat-transfer surfaces in both the condenser and the evaporator thereby minimising the power requirements of the compressor. The optimum use of heat-transfer surfaces makes the system particularly well suited to the use of mixed refrigerant, making it possible to achieve the power saving which is available from the use of such materials.

Embodiments of the present invention will now be described, by way of example only, with reference to the accompanying drawings, in which.

Figure 1:
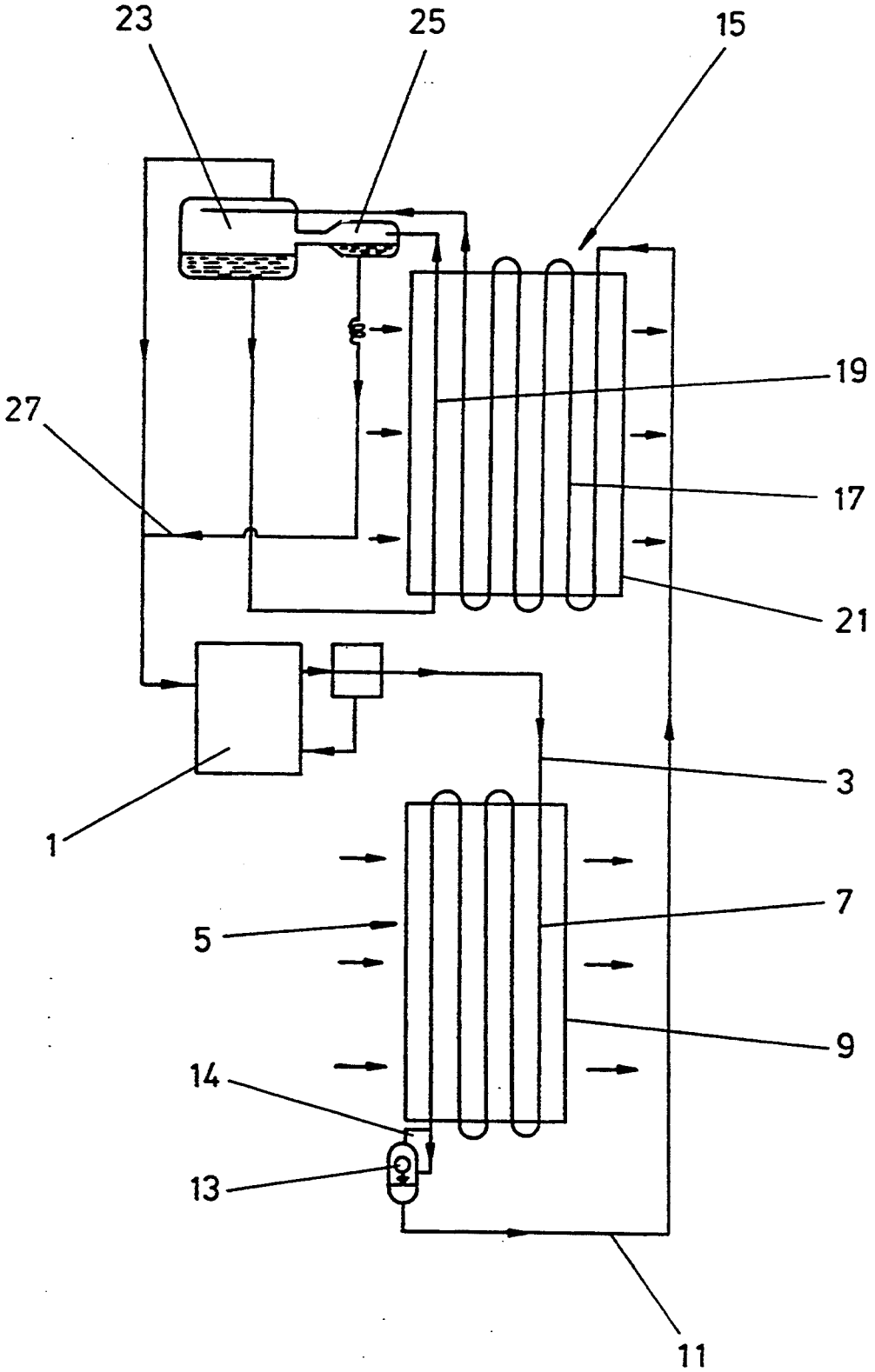
FIG. 1 is a schematic diagram of a vapour compression system in accordance with the present invention.

Referring to the drawings, FIG. 1 shows a vapour compression system which comprises a compressor 1 for increasing the pressure of refrigerant vapour, and for forcing the vapour through a first conduit 3 to a condenser 5. The condenser 5 comprises an array of condenser tubes 7, generally comprising a plurality of tubes connected both in series and in parallel, which are attached to a plurality of fins 9 which facilitate heat transfer between a cooling medium which flows over the fins, and the refrigerant contained within the condenser tubes. The medium might be, for example, air when the system forms part of an air conditioning unit or a refrigerator. The flow directions of the two fluids are essentially countercurrent so this design is suitable for mixed refrigerants as well as pure refrigerants.

Refrigerant is discharged from the condenser 5 into a second conduit 11 through a valve 13. A vapour return tube 14 provided to ensure that the inlet to the valve 13 does not become vapour locked. The valve is arranged to open when the quantity of condensed liquid refrigerant within it lies within a pre-determined range. As will be described in more detail below with reference to FIG. 2, the valve is arranged so that the force required to open it is substantially independent of the pressure drop across it.

Refrigerant from the condenser is passed to an evaporator 15 through the valve 13 and the second conduit 11. The evaporator 15 comprises a first evaporator section 17, comprising an array of tubes connected both in series and in parallel and a second evaporator section 19. It further comprises evaporator fins 21 over which a fluid flows so as to transfer heat and to cause the refrigerant to evaporate. The fluid is cooled as a result. The fluid might be, for example, air when the refrigeration system forms part of an air conditioning unit or a refrigerator.

Refrigerant is discharged from the evaporator 15 into a reservoir 23. The surface area of liquid refrigerant which collects in the reservoir is preferably at least about three times the square of the height of the reservoir. Both in the first evaporator section 17 and the reservoir 23, liquid and vapour refrigerant are kept intimately mixed with one another.

Liquid refrigerant is received from the reservoir 23 through a conduit into the second evaporator section 19, through which it circulates due to vapour-lift action. Refrigerant from the second evaporator section 19 is discharged into an oil concentrator vessel 25. Vapour refrigerant passes from the oil concentrator vessel 25 into the reservoir 23, from which it is supplied to the compressor. The liquid which collects in the oil concentrator vessel 25 is a blend of liquid refrigerant and compressor oil, which may but need not be miscible. The concentration of compressor oil in the liquid in the oil concentrator vessel 25 is high compared with that in the reservoir 23. An oil return line 27 is provided so that the liquid which collects in the oil concentrator vessel 25 can return to the compressor. The flow of liquid through the oil return line 27 is restricted so that it is adequate for oil recirculation, but does not in the case of miscible systems allow excessive amounts of refrigerant to enter the compressor. The size of the oil concentrator is small, so that the volume of liquid which could pass to the compressor on shut-down is small.

The valve 13 is arranged to open under a force which is substantially independent of the pressure drop across it. This has the advantage that the flow of refrigerant from the condenser is substantially steady and, in particular, is not characterised by surges of the refrigerant.

The use of a two-part evaporator 15, which includes first and second evaporator sections 17, 19, has the advantage that, when the system is at steady state, at all points along the length of the first evaporator section 17 the flow rates of liquid and vapour refrigerant can be maintained at a level which gives a high heat transfer coefficient together with an output into the reservoir 23 which consists of refrigerant in two phases. It can be seen that the wetness of the refrigerant discharged from the first evaporator section is dependent directly on the rate of evaporation of refrigerant in the second evaporator section and that the system as a whole will, in due course, achieve a steady state operating condition with high rates of heat transfer being achieved throughout the evaporator. This can be understood in terms of the fixed amount of refrigerant contained within the system as a whole, and the certainty of liquid refrigerant being supplied to the second evaporator conduit 19 to replace that which is evaporated therein.

Figure 2:
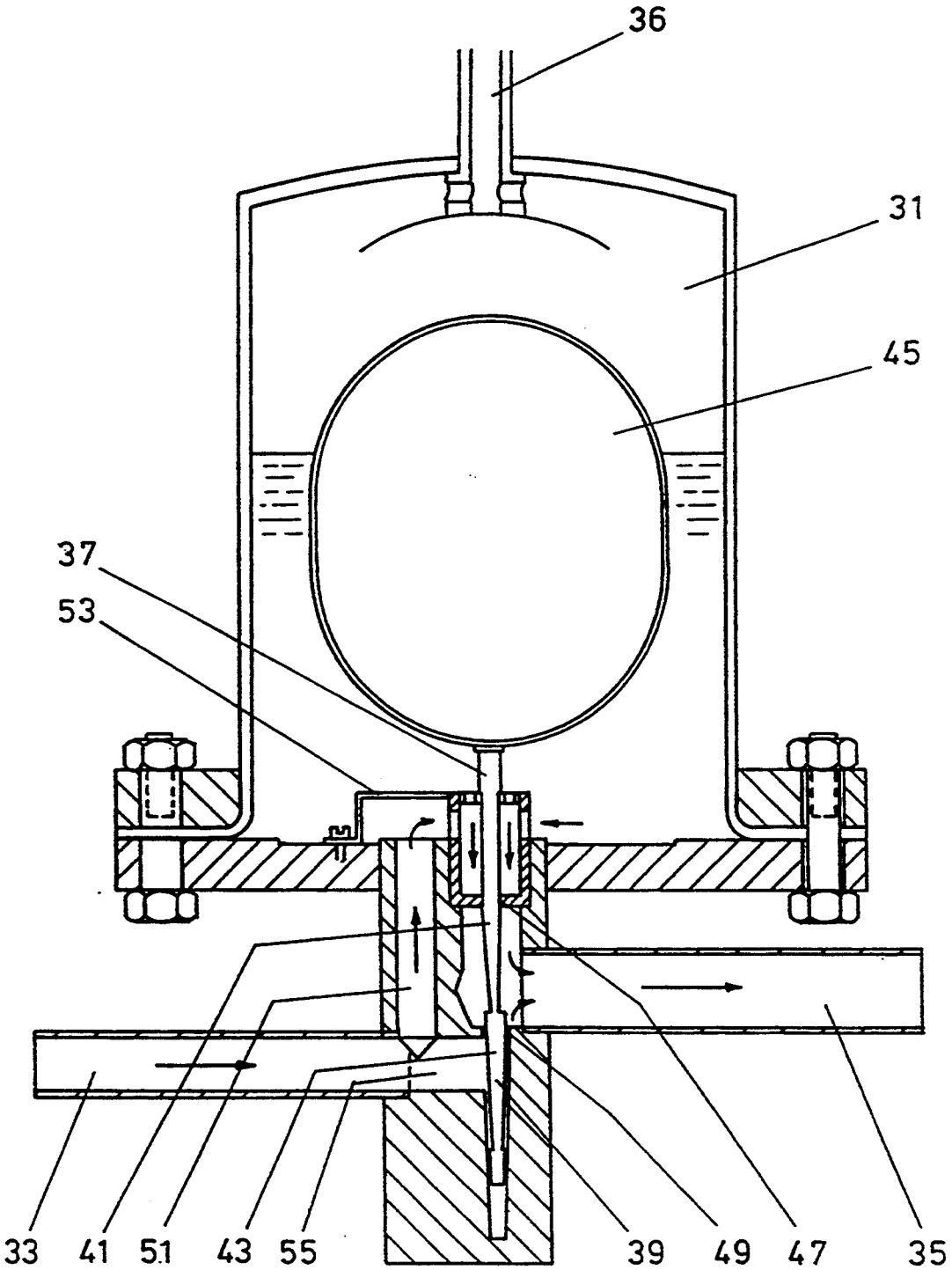
FIG. 2 is a sectional elevation through a valve for use in the system shown in FIG. 1.

FIG. 2 shows a float valve suitable for use in the refrigeration system shown in FIG. 1. The valve comprises a chamber 31 for fluid, which enters the valve through inlet 33 and leaves the valve through outlet 35. A vapour return tube 36 is provided to prevent vapour locking of the liquid feed. A movable valve member 37 consists of a needle 39 which has two tapered portions 41, 43 spaced apart along its length each being surmounted by a short parallel portion which is a close fit in the orifice. The tapered portions of the valve are tapered along about 20 mm. The needle is attached rigidly to a float 45 which is located in the chamber 31.

When the valve is closed, that is when there is insufficient liquid in the chamber 31 to cause the float 45 to lift, the short parallel portions surmounting the tapered portions 41, 43 of the needle 39 are received in respective orifices 47, 49 with a close fit. As the quantity of liquid contained within the chamber 31 increases, the float 45 is caused to lift so that the tapered portions 41, 43 of the needle 39 become displaced from their respective orifices 47, 49.

Fluid entering the valve through the inlet 33 is split into two streams. A first stream enters the chamber 31 through a first sub-inlet 51. As it enters the chamber, it is deflected by a deflector 53 to prevent the inflowing liquid from impinging directly on the float 45. A second stream of liquid flows through a second sub-inlet 55. When the valve is closed or partially open, force is exerted on the valve member 37 by fluid entering the valve through the sub-inlets 51, 55. However, the net force exerted on the valve member by the fluid in the direction in which the valve member moves is approximately zero because the fluid attempting to flow or flowing through the first orifice 47 from the first sub-inlet 51 exerts a force on the valve member 37 which is directly opposed to the force exerted on the valve member by the fluid attempting to flow or flowing through the second aperture 49 from the second-sub inlet 55. As a result, the force required to open the valve or to maintain it in a partially open position is the force required simply to overcome the weight of the valve member 37. The force is therefore substantially independent of the pressure drop across the valve and the flow rate through it, whether the valve is closed or partially or fully open.

This design of valve provides for an essentially steady flow of liquid through the valve, depending on the rate of flow from the condenser. This is in contrast to the somewhat intermittent flow from other float valves in which a single needle is received in its respective orifice, and is particularly advantageous in the vapour compression system of the present invention in which it is desired to produce a steady flow of refrigerant through the evaporator.

Figure 3:
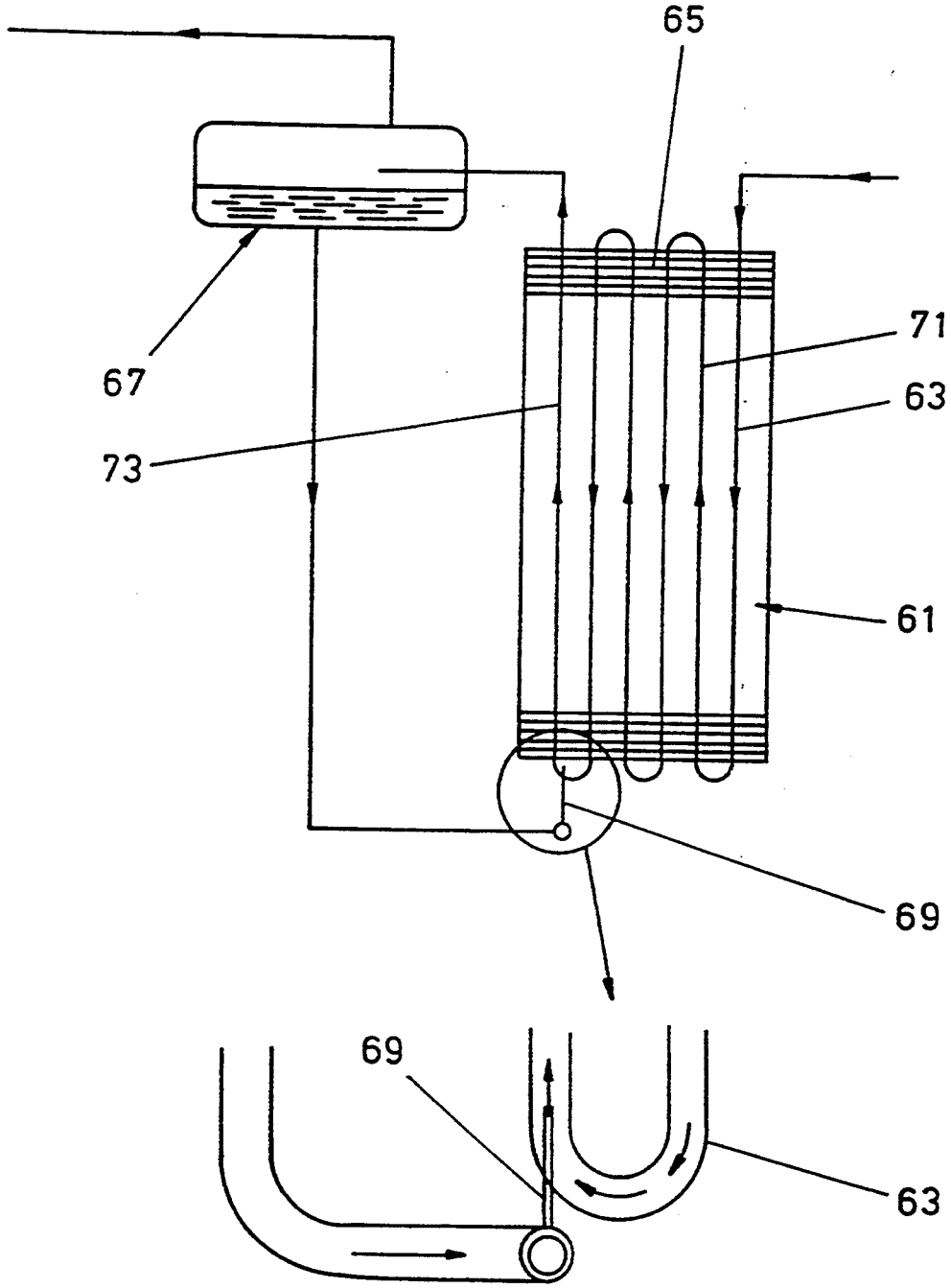
FIG. 3 is a schematic representation of components of an alternative embodiment of refrigeration system.

FIG. 3 shows an evaporator 61 which receives a mixture of liquid and vapour refrigerant from a condenser. The evaporator comprises a single tube 63 which adopts a bustrophedon-like path, or an array of tubes connected in parallel, to which fins 65 are attached to facilitate heat transfer. Refrigerant is discharged from the evaporator tube or tubes 63 into a reservoir 67, from which refrigerant vapour is supplied to a compressor. Liquid refrigerant is supplied from the reservoir 67 into the evaporator tube or tubes 63 through injectors 69. Injection of refrigerant into the tube is encouraged by flow past the injectors of refrigerant which enters the evaporator from the condenser.

The evaporator tube or tubes 63 can be considered to consist of two sections. The first section 71 is upstream of the injectors 69, and the second section 73 is downstream of the injectors. In the first section, the refrigerant which evaporates is that supplied from the condenser, which is supplemented in the second section by that supplied from the reservoir 67. The evaporation in the second section 73 of the evaporator tube 63 of refrigerant supplied from the reservoir 67 can ensure that refrigerant discharged from the tube consists of both liquid and vapour refrigerant.

I claim:

1. A vapour compression system in which a quantity of a refrigerant circulates between at least two pressure levels in a condenser and a two-section evaporator respectively, comprising:

(a) a compressor for increasing the pressure of refrigerant vapour;

(b) the condenser for high pressure refrigerant vapour received from the compressor;

(c) an expansion device, which comprises a valve across which a pressure differential between the condenser and the two-section evaporator is maintained, to control the withdrawal of liquid refrigerant from the condenser, the device being arranged to move at least part way towards its fully open position as the quantity of condensed liquid refrigerant supplied to the expansion device increases above a pre-determined level, the force required to move the device being substantially independent of the pressure drop across it; and (d) the two-section evaporator for liquid refrigerant, which comprises:

(i) a reservoir for liquid refrigerant, from which low pressure refrigerant vapour is supplied to the compressor, (ii) a first evaporator section which receives refrigerant from the condenser through the expansion device and which partially evaporates it, discharging two-phase refrigerant into the reservoir for collection of liquid refrigerant, and (iii) a second evaporator section which receives liquid refrigerant from the reservoir and evaporates it at least partially.

2. A vapour compression system as claimed in claim 1, which is arranged so that the refrigerant flowing in the condenser or the first section of the evaporator flows essentially countercurrently with the fluid with which it is to exchange heat.

3. A vapour compression system as claimed in claim 1, in which the reservoir into which refrigerant is discharged from the first evaporator section is so arranged that refrigerant collected within it has a surface area which is at least about twice the square of the height of the reservoir.

4. A vapour compression system as claimed in claim 1, in which the condenser or first section of the evaporator or both includes junctions or headers between tubes in which refrigerant flows in parallel.

5. A vapour compression system as claimed in claim 1, in which the second evaporator section is provided as at least one tube which is separate from tube or tubes of the first evaporator section.

6. A vapour compression system as claimed in claim 1, in which the first evaporator section includes at least one injection port, for injection from the reservoir into a tube of the first evaporator section.

7. A vapour compression system as claimed in claim 1, in which the length of tube in the first evaporator section is at least three times the length in the second evaporator section.

8. A vapour compression system as claimed in claim 1, which includes an oil concentrator for receiving refrigerant from the second section of the evaporator for return of compressor oil to the compressor.

9. A vapour compression system as claimed in claim 8, in which the oil concentrator is connected by means of an overflow conduit to the reservoir of the evaporator.

10. A vapour compression system as claimed in claim 1 in which the expansion device is a float operated valve.

11. A vapour compression system as claimed in claim 10, in which the valve comprises:

(a) a chamber for refrigerant fluid;

(b) a shaft having two seal portions of approximately the same dimensions spaced apart from one another;

(c) a pair of equally sized orifices into which the seal portions can be received, arranged so that movement of the shaft opens both orifices approximately simultaneously;

(d) an inlet through which fluid enters the chamber, and an outlet through which fluid leaves the chamber, the inlet and outlet being so connected that fluid flows through the orifices in opposite directions; and (e) a float which is attached to the shaft and located in a chamber so that movement of the shaft is dependent on the amount of a liquid in a chamber.

12. A vapour compression system as claimed in claim 11, in which the seal portions on the shaft of the device are tapered.

13. A vapour compression system as claimed in claim 1, in which the second evaporator section is arranged to be in heat exchange with the feed of fluid which is to be cooled by the evaporator.

14. A vapour compression system as claimed in claim 1, which includes a quantity of a refrigerant comprising at least two mutually soluble substances which do not form an azeotrope.

15. A vapour compression system as claimed in claim 1 in which substantially all of the fluid discharged from the expansion device is fed to the first section of the evaporator.

16. A vapour compression system as claimed in claim 16, in which the second evaporator section receives refrigerant exclusively from the reservoir.

17. A vapour compression system in which a quantity of a refrigerant circulates between at least two pressure levels in a condenser and a two-section evaporator respectively, comprising:

(a) a compressor for increasing the pressure of refrigerant vapour;

(b) the condenser for high pressure refrigerant vapour received from the compressor;

(c) an expansion device, which comprises a valve across which a pressure differential between the condenser and the two-section evaporator is maintained, to control the withdrawal of liquid refrigerant from the condenser, the device being arranged to move at least part way towards its fully open position as the quantity of condensed liquid refrigerant supplied to the expansion device increases above a pre-determined level, the force required to move the device being substantially independent of the pressure drop across it;

(d) the two-section evaporator for liquid refrigerant, which comprises:

(i) a reservoir for liquid refrigerant, from which low pressure refrigerant vapour is supplied to the compressor, (ii) a first evaporator section which receives refrigerant from the condenser through the expansion device and which partially evaporates it, discharging two-phase refrigerant into the reservoir for collection of liquid refrigerant, and (iii) a second evaporator section which receives liquid refrigerant from the reservoir and evaporates it at least partially; and (e) a quantity of a refrigerant comprising at least two mutually soluble substances which do not form an azeotrope.

* * * * *

UNITED STATES PATENT AND TRADEMARK OFFICE

CERTIFICATE OF CORRECTION

PATENT NO. : 5,385,034

DATED : January 31, 1995

INVENTOR(S) : Geoffrey G. HASELDEN

It is certified that error appears in the above-indentified patent and that said Letters Patent is hereby On the title page, add item [63] Continuation of PCT/GB91/01706, filed October 3, 1991.

Signed and Sealed this

Twelfth Day of December, 1995

*Attest:*

Bruce Lehman

BRUCE LEHMAN

*Attesting Officer*

*Commissioner of Patents and Trademarks*